US006108999A

United States Patent [19]

Smith et al.

[11] Patent Number: 6,108,999

[45] Date of Patent: Aug. 29, 2000

[54] WINDOW AND GLAZING FOR A WINDOW

[75] Inventors: Dominic Patrick Smith, Bergen Op Zoom; Jan Aalbert Harteveld, Roosendaal, both of Netherlands

[73] Assignee: General Electric Co., Schenectady, N.Y.

[21] Appl. No.: 09/371,140

[22] Filed: Aug. 9, 1999

Related U.S. Application Data

[63] Continuation of application No. PCT/US98/02533, Feb. 6, 1998.

[30] Foreign Application Priority Data

Feb. 10, 1997 [NL] Netherlands ..... 1005224

[51] Int. Cl.[7] ..... E04C 2/54

[52] U.S. Cl. ..... 52/786.1; 52/786.13

[58] Field of Search ..... 52/786.1, 786.11, 52/786.13, 800.16

[56] References Cited

U.S. PATENT DOCUMENTS

| | | | |
|---|---|---|---|
| 5,368,904 | 11/1994 | Stephinson | 52/788 |
| 5,544,465 | 8/1996 | Hood et al. | 52/786.13 |
| 5,553,440 | 9/1996 | Bulger et al. | 52/786.13 |
| 5,644,894 | 7/1997 | Hudson | 52/786.13 |

*Primary Examiner*—Richard Chilcot

[57] ABSTRACT

A window glazing unit is described which has two glass sheets surrounding an impact-resistant thermoplastic sheet. The glazing unit has a structure which avoids formation of condensation within the unit. The glazing unit may be bullet-resistant.

11 Claims, 3 Drawing Sheets

WINDOW AND GLAZING FOR A WINDOW

This is a continuation application of International Application No. PCT/US98/02533 filed Feb. 6, 1998.

This application claims rights of priority based on Dutch Patent Application Serial No. NL 1005224 filed on Feb. 10, 1997, which is hereby incorporated by reference.

BACKGROUND OF THE INVENTION

The present invention relates generally to window glazing units, and more particularly, to window glazing units comprising a shatter-resistant thermoplastic sheet positioned parallel to, and between two glass sheets.

Conventional double-paned window glazing units are frequently employed in construction due to their favorable insulating properties. Such double glazed windows have advantageous thermal insulating properties because a space exists between the two panes of glass. This space acts as a thermal barrier. Such windows have a serious drawback however, in that they remain susceptible to being easily broken.

Triple glazed windows are also know as described, for example in U.S. Pat. No. 5,553,440. Such windows may also be broken easily, particularly if all three sheets of glazing are glass. A further disadvantage of such units is that moisture may condense between the sheets of glazing. Moreover, such window units may fail if the panes are made from different materials, because the pane materials may differ in their coefficient of thermal expansion.

For the foregoing reasons, there is a need for a window glazing unit that is shatter resistant, is thermally efficient, is relatively light and which avoids developing water condensate between its panes. There is a further need for a bullet-resistant glazing having these same properties.

SUMMARY OF THE INVENTION

There is provided, in accordance with the invention, an improved window glazing unit which may be bullet-resistant, which avoids the disadvantages of the prior art, and which offers the advantages of being shatter-resistant (and possibly bullet resistant). The improved window glazing unit also has the ability to remain hermetically sealed through normal atmospheric temperature variations (i.e., −30° F. to 100° F. ), resisting any tendency to separate due to differences in the thermal expansion coefficient of the glazing sheets. Because these windows remain sealed, they do not develop moisture between the panes. Moreover, the windows remain dry inside because they may contain a desiccant as described further below.

In one embodiment of the invention, the window glazing unit comprises two glass sheets and a shatter resistant thermoplastic sheet held parallel to, and between both glass sheets. The thermoplastic sheets are separated from the glass sheet by a U-shaped connecting rib which contacts both glass sheets and the thermoplastic sheet, or by two separate rectangular connecting ribs which respectively connect the first glass sheet with the thermoplastic sheet, and the second glass sheet with the thermoplastic sheet. The rectangular connecting ribs and/or the U-shaped connecting rib may contain a desiccant which is exposed to the spaces between the thermoplastic sheet, and the first and second ribs. Specifically, the sides of the ribs exposed to the interior space of the window may be perforated, or they may have a gas permeable barrier.

In a second embodiment of the invention, the window glazing unit again comprises two glass sheets and a shatter-resistant thermoplastic sheet held between, and parallel to both glass sheets. The edge of the thermoplastic sheet is held within a channel of a U-shaped connecting rib, which runs around the edge of the thermoplastic sheet, and separates the thermoplastic sheet from both glass sheets. The U-shaped connecting rib optionally is surrounded on its outer circumference opposite the edge of the thermoplastic sheet by a supporting strip made from a material permeable to moisture, such as metal or plastic The remaining space between the edges of the glass sheets and the optional supporting strip on the outer edge of the U-shaped connecting rib is typically filled with a sealant.

Both of the above-described embodiments may be built of sufficiently robust materials to act as bullet-resistant glazing. Specifically, the glazing functions as described below. Upon being impacted by a bullet, the first glass surface (i.e. the attack surface) shatters, causing deformation of the bullet. The deformed bullet then impacts the bullet-resistant thermoplastic sheet, and is stopped by said sheet. The thermoplastic sheet deforms, but does not touch the surface of the inner glass sheet or cause breakage thereof. It is thought that the glass sheet at the attack surface causes deformation of the bullet, which helps the thermoplastic sheet to stop the bullet because the impact on the thermoplastic sheet is spread out over a wider area. It should be noted that extreme caution should be exercised in testing any bullet-resistant glazing.

The present invention may be employed to advantage in standard construction glazing applications as well as bullet-proof glazing applications.

These, and other features, aspects, and advantages of the present invention will become better understood with reference to the following description, appended claims, and accompanying drawings.

DETAILED DESCRIPTION

Figure 1:
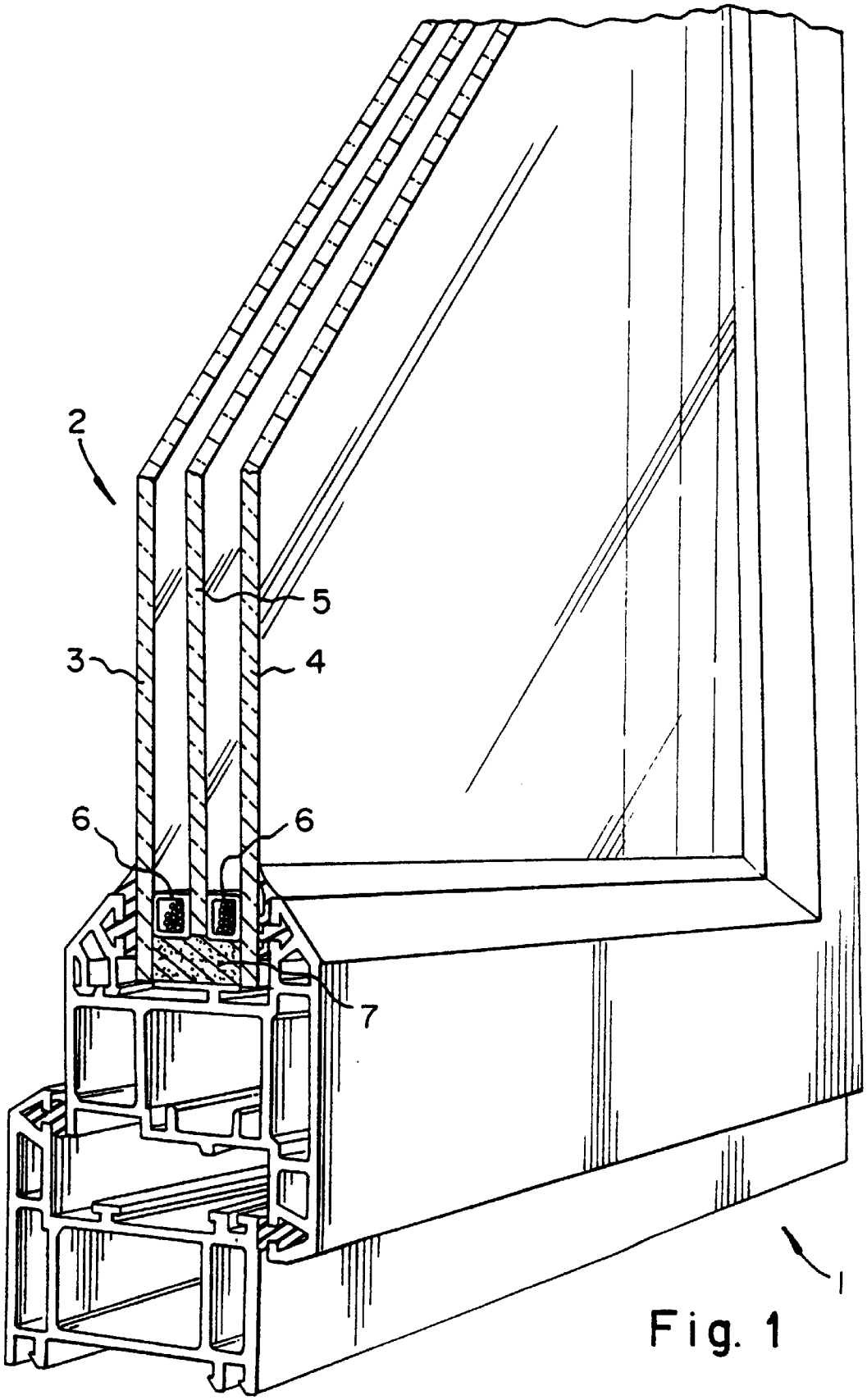
FIG. 1 shows a perspective view of a corner portion of a window according to the invention.

In FIG. 1, Glazing 2 according to the invention is placed in the casing 1. This glazing 2 comprises a pair of panes 3 and 4 made of glass, which are placed at a distance from, and parallel to, each other. In a preferred embodiment of the invention, the panes 3 and 4 are heat tempered glass. The thickness of the glass panes relates to impact resistance and weight requirements. In one embodiment of the invention, the thickness of the glass varies between 4 and 6 mm. The glass panes may themselves comprise several sheets of glass laminated together. A sheet of plastic 5 is installed parallel to, and between, the panes 3 and 4. The sheet of plastic 5 is positioned at a distance from said panes 3 and 4. The sheet of plastic 5 is preferably manufactured from polycarbonate. Alternatively, the plastic may be made from polymethyl methacrylate, polyethylene terepthalates, and other transparent plastics having greater impact resistance than glass.

Figure 2:
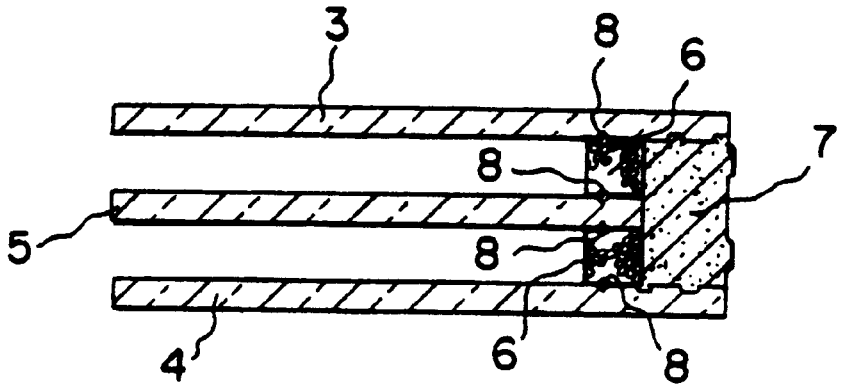
FIG. 2 shows a sectional view of an edge portion of an embodiment of a glazing according to the invention, as used in the window shown in FIG. 1.

In FIG. 2, the edges of panes 3 and 4 project beyond the edge of the sheet 5. Near the edge of the sheet 5 and panes 3 and 4, spacing devices 6 are installed between the sheets of glazing which, for example, may consist of the square or rectangular shapes used in common double glazing. These spacing devices 6 have one side facing the interior space between the plastic sheet 5 and the two panes 3 and 4 which is partially open, coupled by a membrane permeable to moisture, or perforated. The spacing devices may be filled with a desiccant. The space between the panes projecting beyond the peripheral edge of the sheet 5 is filled with a sealant 7, such as hot fusible butyl or silicone, etc. A butyl rubber layer 8 may be applied to the sides of the spacing devices facing the panes 3 and 4 and the sheet 5. This butyl rubber layer 8 deforms to help prevent failure due to differences in thermal expansion between the panes 3 and 4, and the plastic sheet 5.

It should be clear that glazing 2 composed of the panes 3 and 4 with the thermoplastic sheet 5 placed between them with the spacing devices 6 and the butyl sealant 7 can be manufactured to size as a unit in a workshop suitable for this purpose and then placed in the casing to form the window. In such case, a partial vacuum may be created in the spaces between the sheet 5 and the panes 3 and 4. Alternatively, this space may be filled with a gas having a lower thermal conductivity than air. Both of these procedures will make the window more thermally efficient.

Figure 3:
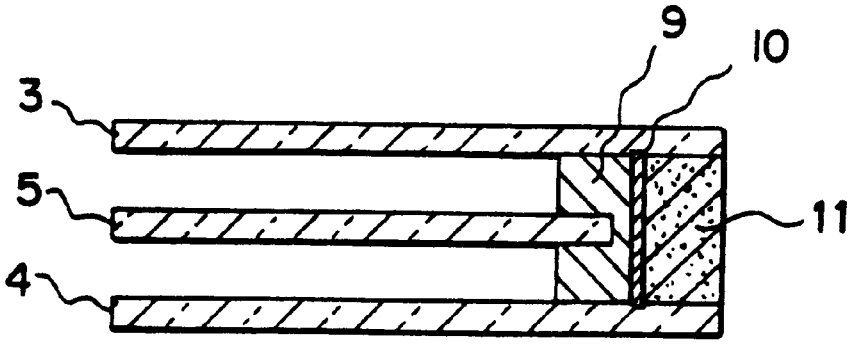
FIG. 3 shows a sectional view corresponding to FIG. 1 of a further embodiment of a.glazing according to the invention. This embodiment employs a U-shaped connecting rib.

FIG. 3 shows an embodiment of the invention wherein a U-shaped connecting rib 9 is attached to the first and second glass panes 3 and 4. The U-shaped connecting rib 9 fastens the first and second panes 3 and 4 substantially parallel to the thermoplastic sheet 5. A supporting strip 10 is oriented substantially perpendicular to, and joins the first and second panes 3 and 4. The supporting strip 10 separates the U-shaped connecting rib 9 from a sealant 11, which fills the remaining space extending to the edges of the first and second panes 3 and 4.

This U-shaped connecting rib 9 can be manufactured from a butyl rubber or similar material, and is preferably reinforced by a metal (e.g., aluminum) strip 10, which is attached to the side of the U-shaped connecting rib 9 facing away from the peripheral edge of the thermoplastic sheet 5.

The sealant 11 may comprise hot fusible butyl rubber, silicone rubber, or other known sealants.

Figure 4:
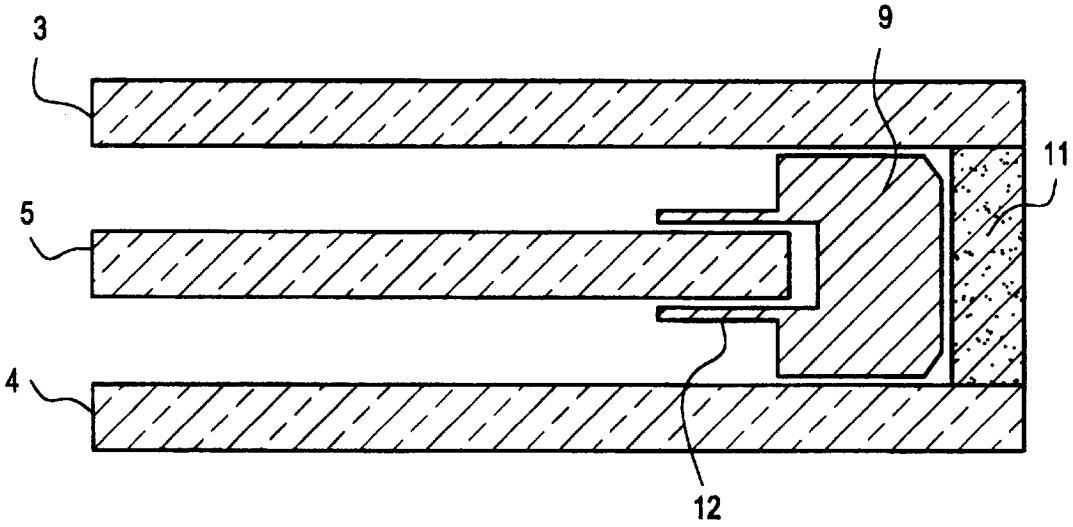
FIG. 4 shows a sectional view of a further embodiment of a glazing according to the invention. This embodiment employs a U-shaped connecting rib having an extended channel.

In the embodiment shown in FIG. 4, the U-shaped connecting rib 9 has a channel 12 which allows for expansion and contraction of the thermoplastic sheet 5.

In the glazings described herein, it is possible to use sheets of a thermoplastic 5 having a coefficient of expansion which differs from that of the panes 3 and 4. It is also possible to use laminated glass sheets to enhance bullet-resistance properties of the glazing.

Many other variants and modifications of the invention will be apparent to those skilled in the art without departing from the spirit and scope of the invention. For example, the glazing could be a fixed window, a window which may be opened, a swing door, a sliding door, or another transparent structural article. The above-described embodiments of the invention are intended to be merely exemplary, and all such variations are intended to be within the scope of the invention as defined in the appended Claims.

We claim:

1. A window glazing unit comprising:

a first glass sheet, a shatter-resistant thermoplastic sheet, having an outer edge and a second glass sheet, wherein the first and second glass sheets have a larger area than the thermoplastic sheet, and the outer edge of the thermoplastic sheet is engaged within a channel of a U-shaped connecting rib, which rib surrounds the outer edge of said shatter-resistant thermoplastic sheet, wherein said U-shaped connecting rib is attached to said first and second glass sheets and fastens said shatter-resistant thermoplastic sheet between, and substantially parallel to, said first and second glass sheets, and wherein said U-shaped connecting rib comprises a desiccant which is exposed to spaces between said first and second glass sheets and said thermoplastic sheet.

2. A window glazing unit according to claim 1, further comprising a supporting strip which is oriented substantially perpendicular to, and joins said first and second glass sheets, wherein said supporting strip divides a sealant from the U-shaped connecting rib.

3. A window glazing unit according to claim 1, wherein said U-shaped connecting rib is fastened to said thermoplastic sheet or said first and second glass sheets by a material capable of stretching to accommodate the differences in thermal expansion coefficient between the glass sheets and the thermoplastic sheet over a normal environment temperature range.

4. A window glazing unit according to claim 1, wherein the channel of the U-shaped connecting rib is extended to have sufficient length to accommodate thermal expansion of the thermoplastic sheet over a normal environmental temperature range.

5. A window glazing unit according to claim 2, wherein the supporting strip is metal or plastic.

6. A window glazing unit according to claim 5, wherein the U-shaped connecting rib is metal or plastic.

7. A window glazing unit according to claim 1, wherein the glass sheets are heat tempered glass.

8. A window glazing unit comprising a first glass sheet, a second glass sheet, and a thermoplastic sheet interposed between and parallel to said first and second glass sheets, wherein said first and second glass sheets are separated from said thermoplastic sheet by a least one spacer device which contain a desiccant therein, which desiccant is exposed to a first space between said first glass sheet and said thermoplastic sheet and is further exposed to a second space between said second glass sheet and said thermoplastic sheet.

9. A window glazing unit according to claim 8, wherein the spacer device consist of two separate devices.

10. A window glazing unit according to claim 8, wherein the spacer device is fastened to said thermoplastic sheet or said first and second glass sheets by a material capable of stretching to accommodate the differences in thermal expansion coefficient between the glass sheets and the thermoplastic sheet over a normal environmental temperature range.

11. A window glazing unit according to claim 8, wherein the glass sheets are heat tempered glass.

* * * * *